US009383110B2

(12) United States Patent
Benedetti et al.

(10) Patent No.: US 9,383,110 B2
(45) **Date of Patent: *Jul. 5, 2016**

(54) FLUSH-MOUNTED FIREPLACE ASSEMBLY

(71) Applicant: Innovative Hearth Products, LLC, Nashville, TN (US)

(72) Inventors: Joseph A. Benedetti, Nashville, TN (US); Amy Grella, Nashville, TN (US)

(73) Assignee: INNOVATIVE HEARTH PRODUCTS, LLC, Nashville, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/638,778

(22) Filed: Mar. 4, 2015

(65) Prior Publication Data

US 2015/0176844 A1 Jun. 25, 2015

Related U.S. Application Data

(62) Division of application No. 13/405,120, filed on Feb. 24, 2012, now Pat. No. 9,004,060.

(51) Int. Cl.

| | |
|---|---|
| ***F24B 1/192*** | (2006.01) |
| ***F24B 1/18*** | (2006.01) |
| ***F24C 3/00*** | (2006.01) |
| ***F24C 3/08*** | (2006.01) |
| ***F23D 14/10*** | (2006.01) |
| ***F23D 14/46*** | (2006.01) |
| ***F23D 14/70*** | (2006.01) |
| ***F24B 1/181*** | (2006.01) |
| ***F24B 1/195*** | (2006.01) |
| ***F24B 1/198*** | (2006.01) |

(52) U.S. Cl.

CPC ..... *F24B 1/192* (2013.01); *F23D 14/10* (2013.01); *F23D 14/46* (2013.01); *F23D 14/70* (2013.01); *F24B 1/18* (2013.01); *F24B 1/181* (2013.01); *F24B 1/1808* (2013.01); *F24B 1/195* (2013.01); *F24B 1/198* (2013.01); *F24B 1/1957* (2013.01); *F24C 3/006* (2013.01); *F24C 3/08* (2013.01); *F23D 2213/00* (2013.01); *Y10T 29/49* (2015.01); *Y10T 29/4935* (2015.01); *Y10T 29/49348* (2015.01); *Y10T 29/49826* (2015.01)

(58) Field of Classification Search

CPC ..... F24C 3/006; F24C 3/08; F23D 14/10; F23D 14/46; F23D 14/70; F23D 2213/00; F24B 1/181; F24B 1/195; F24B 1/1957; F24B 1/1808; F24B 1/18; F24B 1/192; F24B 1/198; Y10T 29/4935; Y10T 29/49826; Y10T 29/49; Y10T 29/49348

See application file for complete search history.

(56) References Cited

U.S. PATENT DOCUMENTS

| | | | | |
|---|---|---|---|---|
| 5,782,231 | A | 7/1998 | Wade | |
| 6,374,822 | B1 * | 4/2002 | Lyons | F23M 5/00 126/500 |
| 2012/0216796 | A1 | 8/2012 | Benedetti et al. | |

*Primary Examiner* — Alfred Basichas

(57) ABSTRACT

A fireplace outer wrap configured to be located behind a mounting wall, the fireplace outer wrap having an outer-wrap opening facing outwards from an opening in the mounting wall. The fireplace comprises a flush-mounted assembly coupled to the fireplace outer wrap, including a surround structure configured to encompass a perimeter of the opening in the mounting wall and be positioned in front of the fireplace outer wrap located behind the mounting wall, and a bezel structure configured to fit within the outer surround structure. An inner edge perimeter of the surround structure and an outer edge perimeter of the bezel structure oppose each other and define a gap between the inner edge perimeter and the outer edge perimeter such that air can flow through the gap. An outside major surface of the surround structure and an outside major surface of the bezel structure are substantially co-planar with each other and with an exterior surface of the mounting wall.

16 Claims, 6 Drawing Sheets

FLUSH-MOUNTED FIREPLACE ASSEMBLY

CROSS-REFERENCE TO RELATED APPLICATION

This application is a Divisional of U.S. application Ser. No. 13/405,120, filed by Joseph A. Benedetti et al. on Feb. 24, 2012, entitled "FLUSH-MOUNTED FIREPLACE ASSEMBLY," which claims the benefit of U.S. Provisional Application Ser. No. 61/446,939, filed by Joseph A. Benedetti et al. on Feb. 25, 2011, entitled "IMPROVED LINEAR FIREPLACE WITH BURNER," commonly assigned with this application and incorporated herein by reference.

TECHNICAL FIELD

This application is directed, in general, to fireplaces and, more specifically, to a front-mounting assembly for a fireplace, and to a method of manufacturing the assembly.

BACKGROUND

The front portion of wall-mounted fireplaces often protrudes one to several inches out from the mounting wall, and, has a large gap surrounding the fireplace window to promote airflow through the fireplace.

SUMMARY

One embodiment of the present disclosure is an in-wall fireplace. The fireplace comprises a fireplace outer wrap configured to be located behind a mounting wall, the fireplace outer wrap having an outer-wrap opening facing outwards from an opening in the mounting wall. The fireplace comprises a flush-mounted assembly coupled to the fireplace outer wrap. The flush-mounted assembly includes a surround structure configured to encompass a perimeter of the opening in the mounting wall and be positioned in front of the fireplace outer wrap located behind the mounting wall. The flush-mounted assembly includes a bezel structure configured to fit within the outer surround structure. An inner edge perimeter of the surround structure and an outer edge perimeter of the bezel structure oppose each other and define a gap between the inner edge perimeter and the outer edge perimeter such that air can flow through the gap. An outside major surface of the surround structure and an outside major surface of the bezel structure are substantially co-planar with each other and with an exterior surface of the mounting wall.

In some embodiments of the in-wall fireplace, a distance perpendicular to the mounting wall between the outside major surface of the surround structure and the exterior surface of the mounting wall, and, a distance perpendicular to the mounting wall between the outside major surface of the bezel structure and the exterior surface of the mounting wall, can both be in the range from about ½ inches to about 3/16 inches. In some embodiments of the in-wall fireplace, a distance perpendicular to the mounting wall between the outside major surface of the surround structure and the exterior surface of the mounting wall, and, a distance perpendicular to the mounting wall between the outside major surface of the bezel structure and the exterior surface of the mounting wall, can both be about ½ inch or less. In some embodiments of the in-wall fireplace, a distance perpendicular to the mounting wall between the outside major surface of the surround structure and the exterior surface of the mounting wall, and, a distance perpendicular to the mounting wall between the outside major surface of the bezel structure and the exterior surface of the mounting wall, can both be about 3/16 inches or less.

In some embodiments of the in-wall fireplace, a plane of the outside major surface of the surround structure and a plane of the outside major surface of the bezel structure can have a separation distance, perpendicular to the mounting wall, of about ⅛ inches or less. In some embodiments of the in-wall fireplace, the inner edge of the surround structure can include a surface that forms a reflex angle with a plane of the outside major surface of the surround structure that can range from greater than about 180 to less than about 270 degrees. In some embodiments of the in-wall fireplace, the inner edge can include a curved surface that curves in a direction that is substantially perpendicular to the mounting wall. In some embodiments of the in-wall fireplace, the inner edge surface that forms the reflex angle can be located along one or both a bottom member and a top member of the surround structure. In some embodiments of the in-wall fireplace, the outer edge of the bezel structure can include a surface that forms a reflex angle with the outside major surface of the bezel structure that ranges from greater than about 270 to less than about 360 degrees. In some embodiments of the in-wall fireplace, one or both the inner edge of the surround structure or the outer edge of the bezel structure can include one or more turbulator structures. In some embodiments of the in-wall fireplace, a width of the gap near edges of the assembly can be greater than the width of the gap near a center of the assembly. In some embodiments of the in-wall fireplace, thicknesses of one or both of the surround structure or bezel structure can be smaller near a center of the assembly than at edges of the assembly. In some embodiments of the in-wall fireplace, the gap between a bottom member of the surround structure and the bezel structure can be substantially laterally parallel to a burner mounted in a fireplace box of the fireplace. In some embodiments of the in-wall fireplace, the flush-mounted assembly can be coupled to the fireplace outer wrap through one or more mounting flanges, each of the mounting flanges being located in between the flush-mounted assembly and a different one or more recessed portions of the fireplace outer wrap. In some embodiments of the in-wall fireplace, each the recessed portions can include upper and lower recessed portions that extend laterally across an entire width of the fireplace outer wrap, and a first one of the first mounting flanges can fit within the upper recessed portion and a second of the mounting flanges fits within the lower recessed portion. In some embodiments of the in-wall fireplace, each one of the mounting flanges can include at least one mounting plate having a plurality holes therein, the holes providing multiple attachment points of the flush-mounted assembly to the fireplace outer wrap at different separation distances between the recessed portion and the flush-mounted assembly.

BRIEF DESCRIPTION OF THE DRAWINGS

Reference is now made to the following descriptions taken in conjunction with the accompanying drawings, in which.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

Embodiments of the present disclosure provide a flush-mounted fireplace assembly to addresses customer demands for a more aesthetically pleasing look, while at the same time meeting requisite technical requirements for air flow and temperature. The flush-mounted fireplace assembly of the disclosure surprisingly also provided several additional benefits as compared to an outwardly protruding fireplace fronts.

The flush-mounted assemblies of the disclosure have enhanced airflow through the fireplace by encouraging natural air convection which helps delivers useful heat from a fireplace to the conditioned space (e.g., a room) which, in turn, allows either greater heat input, or reduced fireplace component costs (e.g., reduced insulation or baffling costs) or installation clearances. The flush-mounted assemblies of the disclosure have enhanced safety because children or pets are less likely to touch, rest on, or run into, the flush-mounted assembly. The flush-mounted assembly stays clean, and is easier to clean, because dirt can not easily accumulate on the vertically oriented exterior surface of the assembly. The flush-mounted assembly occupies less space in the room that the fireplace is mounted in, and, gives the room a more spacious appearance, and has a more built-in look.

Figure 1:
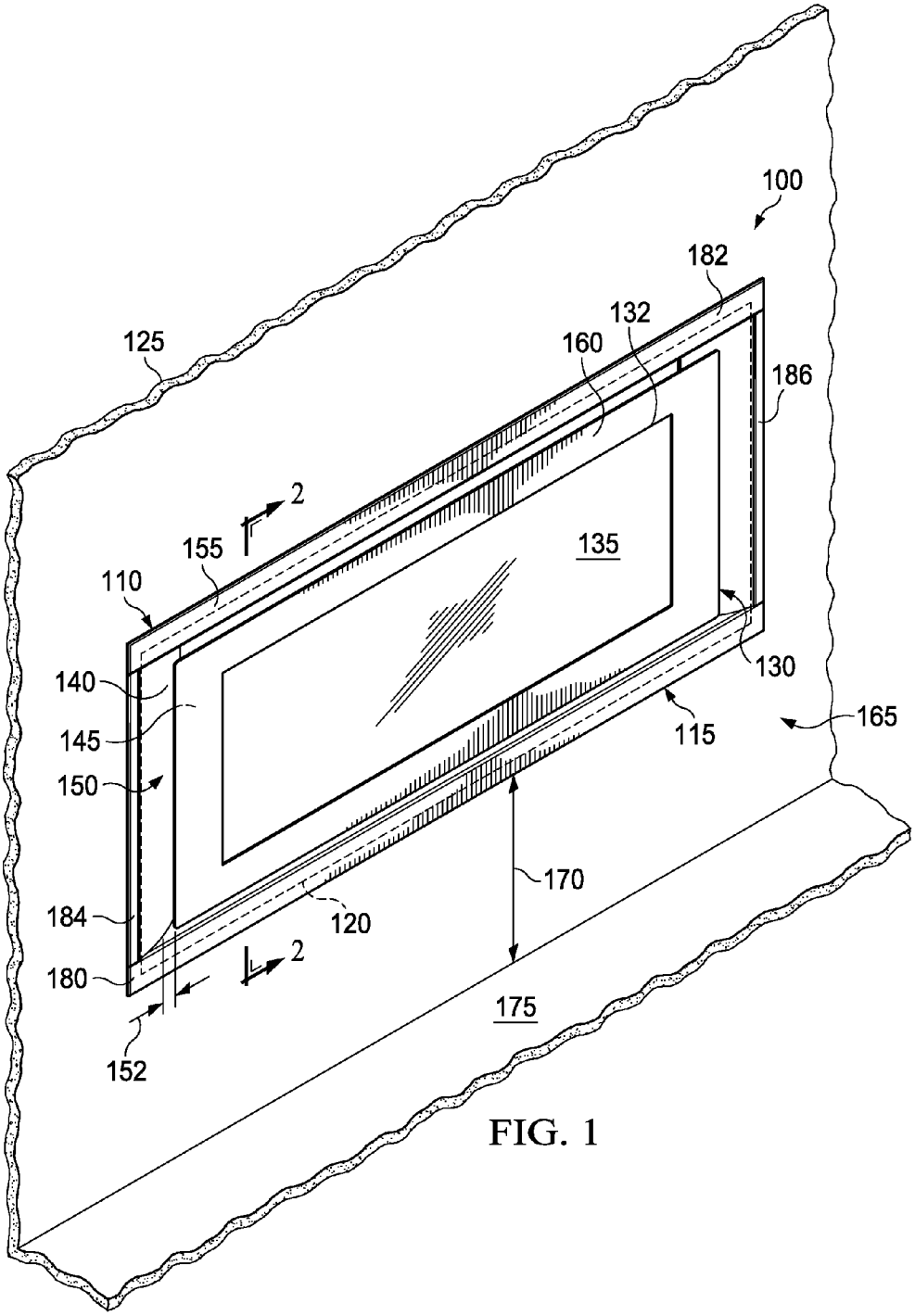
FIG. 1 presents a perspective front view of an example embodiment of a flush-mounted fireplace assembly of the disclosure.
Figure 2:
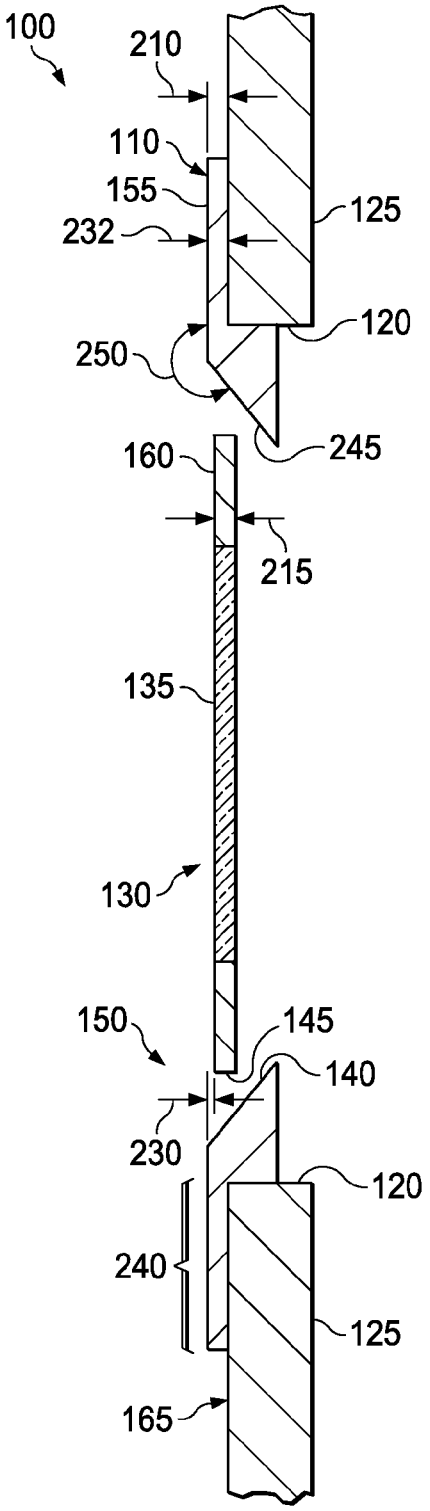
FIG. 2 presents a side view of an example assembly of the disclosure, similar to the assembly depicted in FIG. 1, along view line 2 in FIG. 1.
Figure 3:
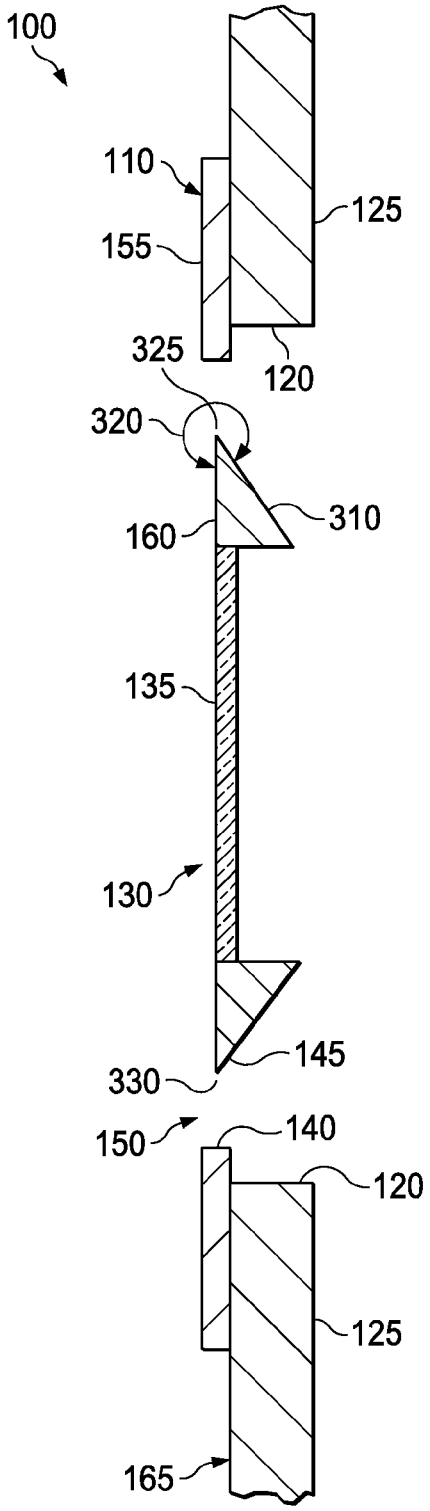
FIG. 3 presents a side view of an alternative example assembly of the disclosure, similar to the assembly depicted in FIG. 1, also along view line 2 in FIG. 1.
Figure 4:
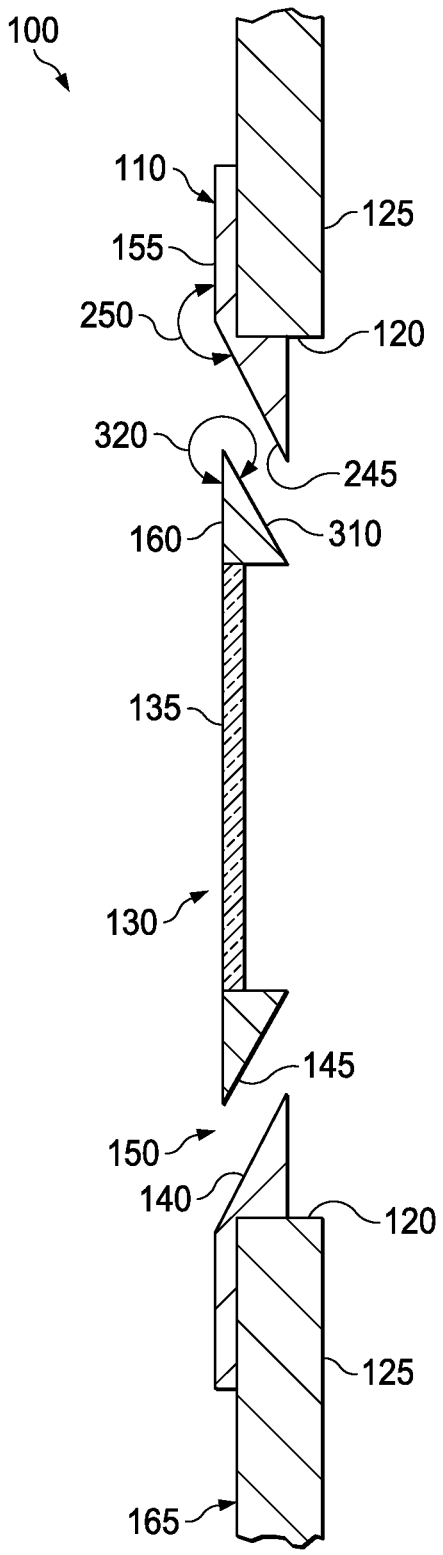
FIG. 4 presents a side view of an alternative example assembly of the disclosure, similar to the assembly depicted in FIG. 1, also along view line 2 in FIG. 1.
Figure 5A:
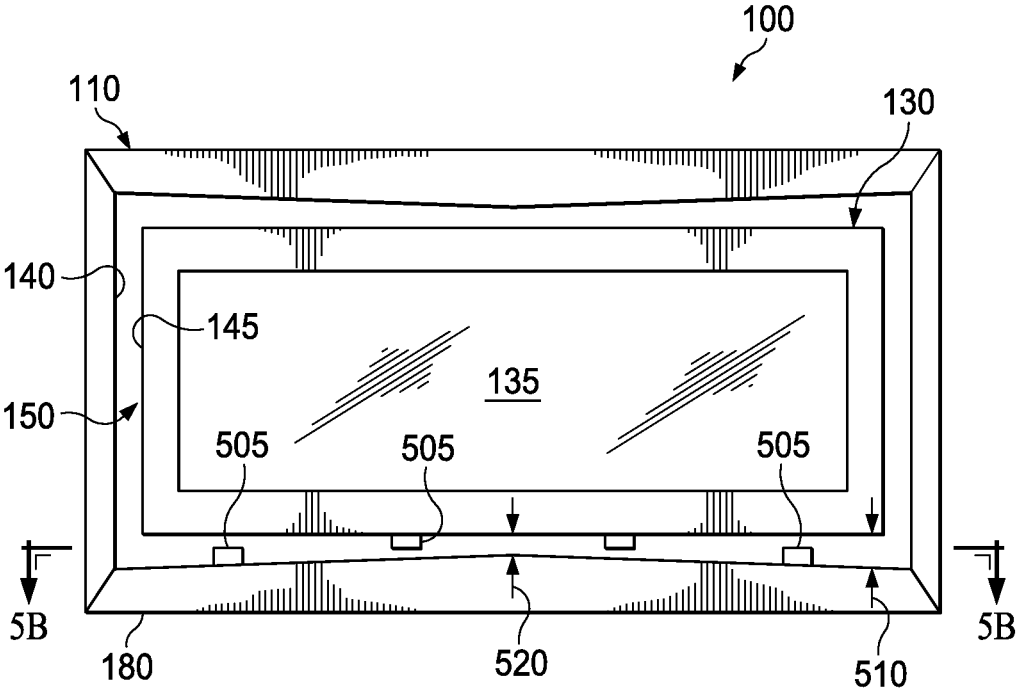
FIG. 5A presents a front view of an alternative example embodiment of a flush-mounted fireplace assembly of the disclosure, similar to the view of the assembly depicted in FIG. 1.
Figure 5B:
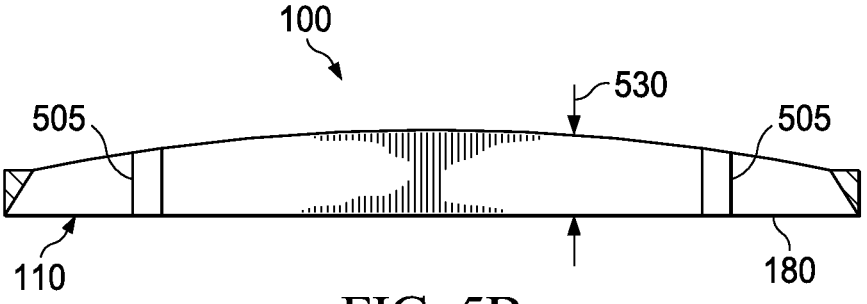
FIG. 5B shows a side view of a member of a surround structure of the flush-mounted fireplace assembly along view line B-B in FIG. 5B.

One embodiment of the present disclosure is a flush-mounted fireplace assembly. FIG. 1 presents a perspective front view of an example embodiment of a flush-mounted fireplace assembly 100 of the disclosure. FIG. 2 presents a side view of an example assembly 100 of the disclosure, similar to the assembly 100 depicted in FIG. 1, along view line 2 in FIG. 1. FIGS. 3 and 4 present side views of alternative example embodiments of the assembly 100, similar to the assembly 100 depicted in FIG. 1, also along view line 2 in FIG. 1. FIG. 5A presents a front view of an alternative example embodiment of a flush-mounted fireplace assembly of the disclosure similar to view of the assembly 100 depicted in FIG. 1, and, FIG. 5B shows a side view through a member of a surround structure assembly 100 along view line B-B in FIG. 5A.

Referring to FIG. 1, the assembly 100 comprises a surround structure 110 configured to encompass a perimeter 115 of a fireplace opening 120 in a mounting wall 125 (e.g., sheet rock or a noncombustible material layer). The assembly 100 also comprises a bezel structure 130 configured to fit within the outer surround structure 110.

In some embodiments the bezel structure 130 can also be configured to hold in an opening 132, one or more transparent window material 135 (e.g., glass) therein. In some embodiments, for example, the bezel structure 130 can be, or include, a door (e.g., a door on spring-loaded hinges) with the opening 132 that holds the transparent window 135. In some cases, the opening 132 of the bezel structure 130 does not hold the transparent window material 135, the window material 135 is coupled to a door of an inner firebox (not shown) of a fireplace and the door is coupled to the bezel structure 130.

An inner edge 140 of the surround structure 110 and an outer edge 145 of the bezel structure 130 oppose each other and define a gap 150 between inner edge 140 and outer edge 145 such that air can flow through the gap 150, e.g., between an interior of a fire place outer wrap of an in-wall fireplace, and a room in which the in-wall fireplace is mounted. In some embodiments the gap 150 has a width 152 (from the inner edge 140 to the opposing outer edge 145) in a range of about ¼ inches to about 1 inch.

An outside major surface 155 of the surround structure 110 and an outside major surface 160 of the bezel structure 130 are substantially co-planar with each other and with an exterior surface 165 of the mounting wall 125.

As further illustrated in FIG. 1 embodiments of the assembly 100 can be mounted to a wall 125 at a range of vertical distances 170 (e.g., 12 inches to 48 inches) above a floor 175.

Referring to FIG. 2, the term substantially co-planar as used herein means that the outside surface 155 of the surround structure 110, and, the outside surface 160 of the bezel structure 130, each project distances 210, 215 perpendicular to the mounting wall 125, that do not extend beyond the exterior surface 165 of the wall 170 by not more than about ¾ inches, and more preferably not more than about ½ inch.

For instance, in some embodiments of the assembly 100, the distance 210 perpendicular to the mounting wall 125 between the outside major surface 155 of the surround structure 110 and the exterior surface 165 of the mounting wall 125, and, a distance 215 perpendicular to the mounting wall 125 between the outside major surface 160 of the bezel structure 130 and the exterior surface 165 of the mounting wall 125, both in the range from about ½ inches to about 3/16 inches. For instance, in some embodiments, the distance 210 perpendicular to the mounting wall 125 between the major outside major surface 155 of the surround structure 110 and the exterior surface 165 of the mounting wall 125, and, the distance 215 perpendicular to the mounting wall 125 between the outside major surface 160 of the bezel structure 130 and the exterior surface 165 of the mounting wall 125, are both about 3/16 inches or less. In some cases, a plane of the outside major surface 155 of the surround structure 110 and a plane of the outside major surface 160 of the bezel structure 130 are substantially coplanar, as defined by having a separation distance 230, perpendicular to the mounting wall 125, of about ⅛ inches or less.

In some embodiments, the distance 210 that the outside major surface 155 projects out from the wall 125 is defined by the thickness 232 of the portion 240 of the surround structure 110 that is adjacent to the exterior surface 165 of the mounting wall 125. For instance, when the portion 240 of the surround structure 110 has a thickness 232 of about ⅜ inches then the distance 210 protruding from the wall 125 is also about ⅜ inches.

As part of the present disclosure, it was discovered that shaping the inner edge 140 of the surround structure 110 and/or the outer edge 145 of the bezel structure 130, could provide new ways to adjust convection airflow through the fireplace and thereby control the amount and distribution of heat flow through the fireplace. Shaping the edges 140, 145 can also help reduce the temperature of the air and hence reduce temperatures inside of the fireplace to within regulated standards (e.g., by reducing the temperature of the window 135 or other outward facing surfaces). For instance, in some cases, shaping the edges can facilitate local regulation of the speed and volume of heated convection air to thereby facilitate control over temperatures to within regulated standards. In some case this could include slowing the air down via restriction or volume and increasing flow, with resultant cooling effects selected desired areas that otherwise would be "hot-spots." For instance, in some cases, shaping the edges can similarly be used to mitigate temperature issues immediately outside of a fireplace.

For instance, as illustrated in FIG. 2, in some embodiments of the assembly 100, to facilitate increased airflow through the gap 150 into a fireplace, it is advantageous for the inner edge 140 of the surround structure 110 to include a surface 245 that forms a reflex angle 250 from the outside major surface 155 of the support structure 110 that is in value in a range of greater than about 180 to less than about 270 degrees, and more preferably from about 225 to about 255 degree. As illustrated in FIG. 2, in some cases, the surface 245 of the inner edge 140 can be or include a planar surface and the reflex angle defines an abrupt transition from the plane of the outside major surface 155 of the surround structure 110 to the inner edge's 140 surface 245. In other cases, however, to further facilitate adjusting airflow through the gap 150, the inner edge 140 can be or include a curved surface 245. For instance, in some cases the inner edge 140 can be or include continuously curving surface 245. In some cases, for example, the curving surface 245 is convex curving outwards from the wall 125 with a radius of curvature in the range from 10 to 20 inches, and more preferably, from 13 to 14 inches.

Based on the present disclosure, one of ordinary skill would appreciate that the inner edge's 140 surface 245 could alternatively be adjusted to have multiple planar surfaces, each surface with a different reflex angle 250, or, that different portions of the surround structure 110 could have an edge 140 with different reflex angle 250.

As illustrated in FIG. 1, some embodiments of the surround structure 110 can have a top, bottom and two vertical members 180, 182, 184, 186 that are coupled together. Referring the FIGS. 1 and 2 continuously throughout, in some embodiments, only the bottom member 180, that is, the horizontal member closest to a floor 175 when mounted on the wall 125, may include the inner edge 140 with an angled or curved surface 245 and having the reflex angle 250 as described above. It can be advantageous for the bottom member 180, such as when it is the member that is closest to the burner of the fireplace, to have the angled or curved surface 245 to facilitate a greater convection air inflow, and hence greater useful heat production in the conditioned space. In some cases, the top member 182, that is, the horizontal member farthest from the floor 175 when mounted on the wall 125, has the inner edge 140 with an angled or curved surface 245 such as described above. It can be advantageous for the top member 182, the member highest above the burner, to have the angled or curved surface 245 to facilitate a greater outflow of air from the fireplace. In some cases, to promote a vertical flow of air into the gap 150 nearest the assembly bottom 180 and out through the gap 150 nearest the assembly top 182, the inner edge 140 with the angled or curved surface 245, can be located along all or a portion of the long dimension of both the bottom member 180 and the top member 182 of the surround structure 110. In still other cases, the inner edge 140 with the angled or curved surface 245 can be along the entire, or, a portion of the long dimension of the vertical members 184, 186.

In some embodiments of the assembly 100, such as further illustrated in FIG. 3, the outer edge 145 of the bezel structure 130 can include a surface 310 that forms a reflex angle 320 from the outer major surface 160 of the bezel structure 130 that is in a range from greater than about 270 to less than about 360 degrees, and more preferably, from about 305 to about 325 degrees. Any of the features of the inner edge's 140 surface 245 discussed above, can also be included as features of the outer edge's 145 surface 310. For instance, the outer edge 145 can be or include a planar surface 310, or, have multiple planar surfaces each having different reflex angles 320, or have a curved surface. For instance, all, or portions, of the outer edge 145 of the bezel structure 130 can form the angled planar or curved surface 310. For example, as illustrated in FIG. 3, one or both of a top edge 325 and a bottom edge 330 of the bezel structure 130 can include the angles or curved surface 310, as could vertical edges (not shown in FIG. 3) of the bezel structure 130.

In some embodiments of the assembly 100, such as further illustrated in FIG. 4, both the inner edge 140 of the surround structure 110 and the outer edge 145 of the bezel structure 130 can include surfaces 245, 310 that can form the reflex angles 250, 320, as described above. Providing angled surfaces 245, 310 on the both the inner edge 140 and the outer edge 145, respectively, can further increase air flow circulating into and out of the fireplace. For instance, the inner edge 140 surface 245 forms a reflex angle 250 from the exterior surface of the mounting wall 125 that is in the range from greater than about 180 to less than about 270 degrees, and more preferably from about 225 to about 255 degree. For instance, the outer edge 145 has a surface 310 that forms a reflex angle 320 that is in the range from greater than about 270 to less than about 360 degrees, and more preferably, from about 305 to about 325 degrees.

Figure 5C:
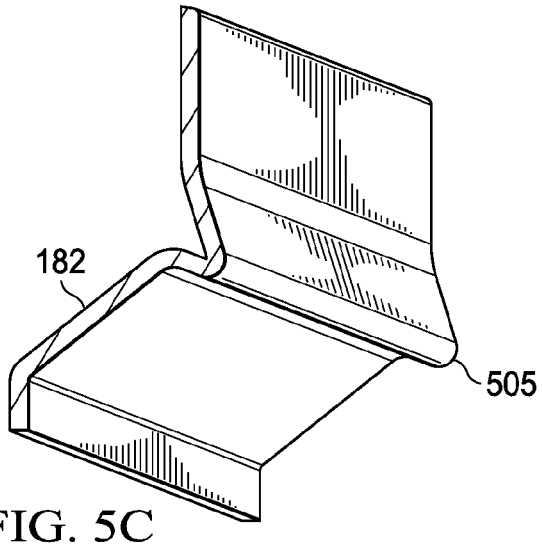
FIG. 5C shows a perspective view of an example turbulator structure such as the turbulator structure in the example assembly shown in FIG. 5A.

As further illustrated in FIGS. 5A and 5B, in some embodiments of the assembly 100, one or both the inner edge 140 of the surround structure 110 or the outer edge 145 of the bezel structure 130 can include one or more turbulator structures 505 thereon or there-across. For instance, portions of the surface 245 of the inner edge 140 of surround structure 110 or the surface 310 of the outer edge 145 of the bezel structure 130 can further include one or more turbulator structures 505 thereon. The turbulator structures 505 are configured to add turbulent flow to the air flowing through the gap 150. Adding turbulence to the air flowing through the gap 150 can help reduce the temperature of the air and hence reduce temperatures inside of the fireplace to within regulated standards (e.g., the temperature of the window 135). In some cases, turbulator structures 505 could be employed along the top member 182 edge 140 where the conditioned air is exiting the assembly 100, and thereby help cool the discharge air thus reducing temperatures immediately outside the assembly 100 where the air could comes in contact with the temperature-sensitive wall structures or facing materials. FIG. 5C shows a perspective view of an example turbulator structure 505 such as the turbulator structures in the example assembly shown in FIG. 5A. As illustrated in FIG. 5C, in some embodiments, the turbulator structure 505 can be incorporated into, and run the full long axis length of, one or more of the support structure 110 members (e.g., member 182). Such a turbulator structure 505 could be used to facilitate mixing of the convection air with the cooler room air to mitigate temperature issues directly above the fireplace. One of ordinary skill in the art would appreciate how to adjust the number, distribution and shapes of turbulator structures 505 to control the turbulence of air flowing through the gap 150 as desired.

As part of the present disclosure, it was also discovered that adjusting the width 152 of the gap 150 between the inner edge 140 of the surround structure 110 and the outer edge 145 of the bezel structure 130, provided another new way to adjust airflow into the fireplace and thereby control the amount and distribution of heat flow in the fireplace. For instance, as illustrated in FIG. 5A, in some embodiments the gap 150 has a greater width 510 nearer edges of the assembly 100 than the width 530 near a center of the assembly 100. For instance, in some embodiments, for at least a portion of the gap 150 (e.g., the gap 150 along the bottom member 180) the width 520 at the center is in the range of about ⅜ inches to about ⅝ inches and the width 510 at the edges is in the range of about ⅞ inches and about 1⅛ inches. By making the width 520 smaller at the center than the width 530 at the edges, air flow into the gap 150 is forced towards the edges of the assembly 100, which in turn, causes there to be more heat at the edges and less heat at the center. In other cases, however less airflow in a particular region could result in more localized heat build up, but at the same time desirably reduce heat transfer to outside of the fireplace. Based on the present disclosure, one of ordinary skill in the art would appreciate how the width 510, 530 of the gap 150 could be varied continuously between the center and the edges, or varied discontinuously to fine-tune the airflow, if desired.

As part of the present disclosure, it was further discovered that heat distribution within a fireplace can be further controlled by adjusting the thickness of the surround structure 110, or bezel structure 130, of the assembly 100. For instance, referring to FIG. 5B, in some embodiments of the assembly 100, a thickness 530 of the surround structure 110 (or a thickness of the bezel structure 130, not shown), or both can be larger at the nearer the edges of the assembly 100 than at the center of the assembly 100. For example, in some embodiments, the surround structure 110 has a thickness 530 in the range of from about ⅜ inches to about ⅝ inches at the edges and a thickness 420 in a range of about ⅜ inches to about ⅜ inches at the center. For such embodiments, heat flows from the thinner portions towards the thicker portions of the surround structure 110 (or bezel structure 130 when similarly configured), and consequently, heat is dissipated from the center towards the edges of the assembly 100. Based on the present disclosure, one of ordinary skill in the art would appreciate that the thickness 530 could be varied continuously between the center and the edges, or varied discontinuously to fine-tune the heat flow, if desired. For instance, in some cases, the thickness of the surround structure 110, or bezel structure 130, could be suitably adjusted in more than one plane to provide the desired heat distribution effect.

Figure 6:
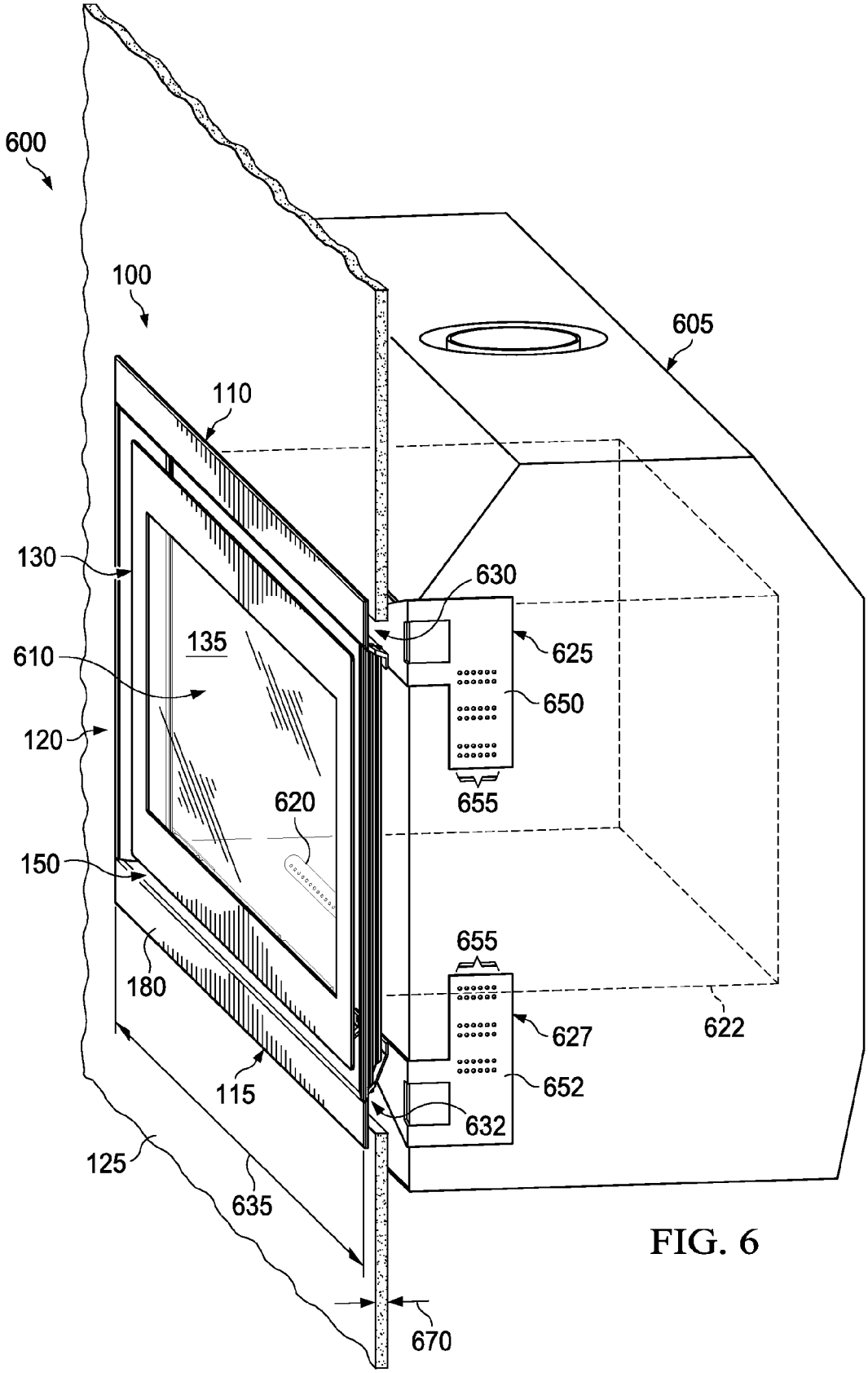
FIG. 6 presents a cut-away perspective view of an example embodiment of selected portions of a fireplace of the disclosure, the fireplace including the disclosed flush-mounted assembly, including any of the embodiments discussed in the context of FIG. 1-5.

Another embodiment of the disclosure is an in-wall fireplace, e.g., a direct vent fireplace, where all the air for combustion comes from outside the fireplace. FIG. 6 presents a cut-away perspective view of an example embodiment of selected portions of an in-wall fireplace 600 of the disclosure. As illustrated in FIG. 6, the in-wall fireplace 600 comprises a fireplace outer wrap 605 configured to be located behind a mounting wall 125, the fireplace outer wrap 605 having an outer-wrap opening 610 facing outwards from an opening 120 in the mounting wall 125. The in-wall fireplace 600 comprises a flush-mounted assembly 100 coupled to the fireplace outer wrap 605, the flush-mounted assembly 100. The flush-mounted assembly 100 can include any of the embodiments the assemblies 100 discussed in the context of FIG. 1-5. That is, the assembly 100 includes the surround structure 110 configured to encompass a perimeter 115 of the opening 120 in the mounting wall 125 and the bezel structure 130 configured to fit within the outer surround structure 110.

As illustrated and discussed in the context of FIGS. 1 and 2 an inner edge 140 of the surround structure 110 and an outer edge 145 of the bezel structure 130 oppose each other and define a gap 150 between inner edge 140 and outer edge 145 such that air can flow through the gap 150. An outside major surface 155 of the surround structure 110 and an outside major surface 160 of the bezel structure 130 are substantially co-planar with each other and with an exterior surface 165 of the mounting wall 125. In some embodiments, a distance 210 perpendicular to the mounting wall 125 between the outside major surface 155 of the surround structure 110 and the exterior surface 165 of the mounting wall 125, and, a distance 215 perpendicular to the mounting wall 125 between the outside major surface 160 of the bezel structure 130 and the exterior surface 165 of the mounting wall 125, are both about ½ inches or less.

As illustrated in FIG. 6, in some embodiments of the in-wall fireplace 600, the gap 150 between a bottom member 180 of the surround structure and the bezel structure 130 is substantially laterally parallel to a burner 620 mounted inside an inner firebox 622 of the fireplace 600. However, in other embodiments of the fireplace 600 to facilitate heat transfer, there may be a plurality of burners or differently shaped burners and the bezel structure 130 may be situated substantially laterally parallel with the lower most burner, or in other cases, a substantially laterally parallel mid-line of all of the burners.

As further illustrated in FIG. 6, in some embodiments of the in-wall fireplace 600, the flush-mounted assembly 100 is coupled to the fireplace outer wrap 605 through one or more mounting flanges 625, 627 each of the mounting flanges 625 being located in between the flush-mounted assembly 100 and a different one or more recessed portions 630, 632 of the fireplace outer wrap 605.

For instance, in some embodiments, the fireplace outer wrap 605 includes an upper recessed portion 630 and lower recessed portion 632, each of the recessed portions extend laterally across an entire width 635 of the fireplace outer wrap 605, and the first mounting flange 625 fits within the upper recessed portion 630 and the second mounting flange 627 fits within the lower recessed portion 632. Both the first and second mounting flange 625, 627 can also extend over the entire width 635 of the fireplace outer wrap 605.

In some embodiments, each one of the mounting flanges 625, 627 includes at least one mounting plate (e.g., plates 650, 652) having a plurality holes 655 therein, the holes 655 providing multiple attachment points of the flush-mounted assembly 100 to the outer wrap at different separation distances 660 between the recessed portion (e.g., portions 630, 632) and the flush-mounted assembly 100. For instance, there can be multiple rows and columns of holes with the columns spaced apart, to accommodate different thickness 670 mounting wall, e.g., thickness 670 of ¼, ½ or ⅜ inch dry wall, ceramic tile, rock, slate, or other non-combustible material.

Figure 7:
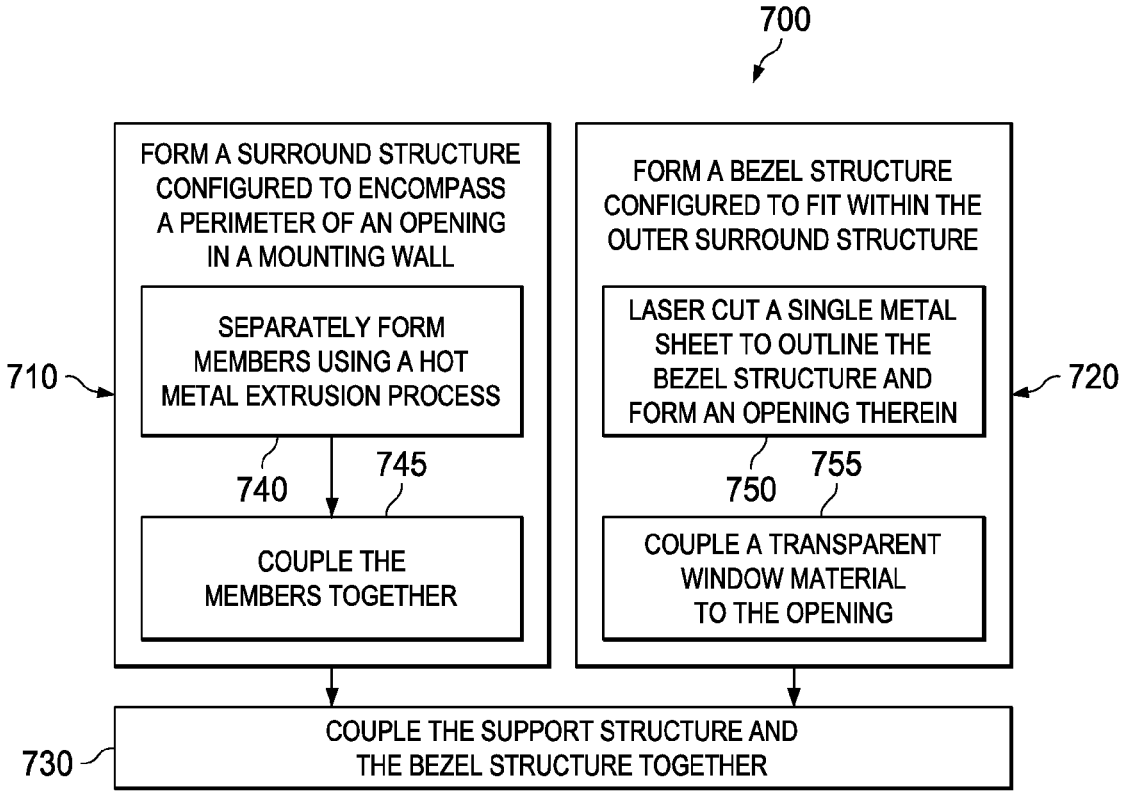
FIG. 7 presents a flow diagram of an example method of manufacture which includes fabricating the disclosed flush-mounted assembly, including any of the example embodiments discussed in the context of FIGS. 1-6.

Another embodiment of the present disclosure is a method of manufacturing a flush-mounted fireplace assembly, such as any of the flush-mounted fireplace assemblies 100 discussed in the context of FIGS. 1-6. FIG. 7 presents a flow diagram of an example method 700 of manufacture.

With continuing reference to FIGS. 1-6 throughout, the example method 700 illustrated in FIG. 7 comprises a step 710 of forming a surround structure 110 configured to encompass a perimeter 115 of an opening 120 in a mounting wall 125. The method 700 further comprises a step 720 of forming a bezel structure 130 configured to fit within the outer surround structure 110.

The method 700 also comprises coupling the surround structure 110 and the bezel structure 130 together such that an inner edge 140 of the surround structure 110 and an outer edge 145 of the bezel structure 130 oppose each other and define a gap 150 between inner edge 140 and outer edge 145 such that air can flow through the gap 150. The coupling step 730 also is done such that an outside major surface 155 of the surround structure 110 and an outside major surface 160 of the bezel structure 130 are substantially co-planar with each other and with an exterior surface 165 of the mounting wall 125 when mounted thereto. In some embodiments the coupling step 730 includes coupling the surround structure 110 and the bezel structure 130 directly or indirectly together using hinges or other reversible coupling means so as to permit access into the outer-wrap opening 610, e.g., for cleaning or maintenance.

In some embodiments, the step 710 of forming the surround structure includes a step 740 of separately forming the surround structure members, e.g., a top member 180, a bottom member 182, and side members 184, 186 using a hot metal extrusion process, followed by a step 745 of coupling together top member 180, a bottom member 182, and side members 184, 186. In some embodiments, the step 745 to couple the members 180-186 together can include welding, bolting, screwing or clamping the ends of the adjacent member 180-186 together.

In some cases the hot metal extrusion process of step 740 includes extruding hot aluminum into one or more dies casts prepared for each of the members 180-186. The use of the hot metal extrusion process facilitates providing a smooth continuous look to the members 180-186 and can facilitate the formation of optional features of the surround structure 100 such as the angled or curved edge 146, turbulators 505, variable thicknesses 420 of the one or more of the members 180-186 and providing members 180-186 with shapes to impart variable widths 510, 530 separating the inner and outer edges 140, 145. However, in other embodiments, the members 180-186 and the optional features can be formed by other procedures such as machine cutting and bending separate metal sheets and coupling the metal sheets together, or using casted metal parts, or flat metal pieces welded or otherwise fastened together.

In some embodiments, the step 720 of forming the bezel structure includes a step 750 of laser cutting a single metal sheet (e.g., a steel sheet) to outline the structure 130 and an opening 132 therein. In some embodiment, in a step 755 a transparent window material 135 is coupled to the opening 132. Using a laser cutting process can facilitate providing a smooth continuous look to the bezel structure 130. In other embodiments different cutting procedures, or other forming processes such as hot metal extrusion, could be used to form the bezel structure as part of step 720.

Those skilled in the art to which this application relates will appreciate that other and further additions, deletions, substitutions and modifications may be made to the described embodiments.

The invention claimed is:

1. An in-wall fireplace, comprising:

a fireplace outer wrap configured to be located behind a mounting wall, the fireplace outer wrap having an outer-wrap opening facing outwards from an opening in the mounting wall;

a flush-mounted assembly coupled to the fireplace outer wrap, the flush-mounted assembly including:

a surround structure configured to encompass a perimeter of the opening in the mounting wall and be positioned in front of the fireplace outer wrap located behind the mounting wall; and a bezel structure configured to fit within the outer surround structure, wherein:

an inner edge perimeter of the surround structure and an outer edge perimeter of the bezel structure oppose each other and define a gap between the inner edge perimeter and the outer edge perimeter such that air can flow through the gap, and an outside major surface of the surround structure and an outside major surface of the bezel structure are substantially co-planar with each other and with an exterior surface of the mounting wall.

2. The in-wall fireplace of claim 1, wherein a distance perpendicular to the mounting wall between the outside major surface of the surround structure and the exterior surface of the mounting wall, and, a distance perpendicular to the mounting wall between the outside major surface of the bezel structure and the exterior surface of the mounting wall, are both in the range from about ½ inches to about 3⁄16 inches.

3. The in-wall fireplace of claim 1, wherein a distance perpendicular to the mounting wall between the outside major surface of the surround structure and the exterior surface of the mounting wall, and, a distance perpendicular to the mounting wall between the outside major surface of the bezel structure and the exterior surface of the mounting wall, are both about ½ inch or less.

4. The in-wall fireplace of claim 1, wherein a distance perpendicular to the mounting wall between the outside major surface of the surround structure and the exterior surface of the mounting wall, and, a distance perpendicular to the mounting wall between the outside major surface of the bezel structure and the exterior surface of the mounting wall, are both about 3⁄16 inches or less.

5. The in-wall fireplace of claim 1, wherein a plane of the outside major surface of the surround structure and a plane of the outside major surface of the bezel structure have a separation distance, perpendicular to the mounting wall, of about ⅛ inches or less.

6. The in-wall fireplace of claim 1, wherein the inner edge of the surround structure includes a surface that forms a reflex angle with a plane of the outside major surface of the surround structure that ranges from greater than about 180 to less than about 270 degrees.

7. The in-wall fireplace of claim 6, wherein the inner edge includes a curved surface that curves in a direction that is substantially perpendicular to the mounting wall.

8. The in-wall fireplace of claim 6, wherein the inner edge surface that forms the reflex angle is located along one or both a bottom member and a top member of the surround structure.

9. The in-wall fireplace of claim 1, wherein the outer edge of the bezel structure includes a surface that forms a reflex angle with the outside major surface of the bezel structure that ranges from greater than about 270 to less than about 360 degrees.

10. The in-wall fireplace of claim 1, wherein one or both the inner edge of the surround structure or the outer edge of the bezel structure include one or more turbulator structures.

11. The in-wall fireplace of claim 1, wherein a width of the gap near edges of the assembly is greater than the width of the gap near a center of the assembly.

12. The in-wall fireplace of claim 1, wherein thicknesses of one or both of the surround structure or bezel structure is smaller near a center of the assembly than at edges of the assembly.

13. The in-wall fireplace of claim 1, wherein the gap between a bottom member of the surround structure and the bezel structure is substantially laterally parallel to a burner mounted in a fireplace box of the fireplace.

14. The in-wall fireplace of claim 1, wherein the flush-mounted assembly is coupled to the fireplace outer wrap through one or more mounting flanges, each of the mounting flanges being located in between the flush-mounted assembly and a different one or more recessed portions of the fireplace outer wrap.

15. The in-wall fireplace of claim 14, wherein each the recessed portions include upper and lower recessed portions that extend laterally across an entire width of the fireplace outer wrap, and a first one of the first mounting flanges fits within the upper recessed portion and a second of the mounting flanges fits within the lower recessed portion.

16. The in-wall fireplace of claim 14, wherein each one of the mounting flanges includes at least one mounting plate having a plurality holes therein, the holes providing multiple attachment points of the flush-mounted assembly to the fireplace outer wrap at different separation distances between the recessed portion and the flush-mounted assembly.

* * * * *